US007216402B2

(12) United States Patent
Nishiyama et al.

(10) Patent No.: US 7,216,402 B2
(45) Date of Patent: May 15, 2007

(54) DOOR HANDLE SYSTEM

(75) Inventors: Masayuki Nishiyama, Chigasaki (JP); Katsuyasu Tomiji, Kamakura (JP)

(73) Assignee: Nifco Inc., Yokohama (JP)

( * ) Notice: Subject to any disclaimer, the term of this patent is extended or adjusted under 35 U.S.C. 154(b) by 103 days.

(21) Appl. No.: 11/117,448

(22) Filed: Apr. 29, 2005

(65) Prior Publication Data

US 2005/0251959 A1 Nov. 17, 2005

(30) Foreign Application Priority Data

May 13, 2004 (JP) ..... 2004-143133
Apr. 21, 2005 (JP) ..... 2005-123357

(51) Int. Cl.
*E05B 3/00* (2006.01)

(52) U.S. Cl. ..... 16/412; 16/50; 292/336.3; 292/DIG. 23

(58) Field of Classification Search ..... 16/412, 16/50, 59, 60, 347, 374, 352; 292/336.3, 292/DIG. 23; 296/1.02; 188/267.1, 266.1, 188/266.2
See application file for complete search history.

(56) References Cited

U.S. PATENT DOCUMENTS 3,020,075 A * 2/1962 Johnstone et al. ..... 292/336.3
4,038,718 A * 8/1977 Reilhac et al. ..... 292/336.3
5,005,885 A 4/1991 Kobayashi et al.
5,210,905 A * 5/1993 Dietz et al. ..... 16/429
5,509,703 A * 4/1996 Lau et al. ..... 292/1
5,743,575 A 4/1998 McFarland
5,862,896 A * 1/1999 Villbrandt et al. ..... 188/293
6,059,329 A * 5/2000 Spitzley ..... 292/336.3
6,536,080 B2 3/2003 Bella et al.
6,591,454 B2 * 7/2003 Brustle ..... 16/374
6,684,453 B2 * 2/2004 Wang ..... 16/54
6,712,409 B2 * 3/2004 Monig ..... 292/336.3

FOREIGN PATENT DOCUMENTS

EP 1 249 567 10/2002
JP 02269282 A * 11/1990
JP 07-039771 2/1995
JP 1 031 682 8/2000

* cited by examiner

*Primary Examiner*—Chuck Y. Mah
*Assistant Examiner*—Michael J. Kyle
(74) *Attorney, Agent, or Firm*—Manabu Kanesaka

(57) ABSTRACT

A door handle system includes a door opening lever rotationally supported on a support member, and a damper having a linear piston sliding mechanism. The door opening lever has an angle change device for changing an angle when the door opening lever is actuated. The damper is attached to the support member and arranged to contact the angle change device so that a returning force of the door opening lever after being opened is reduced by the damper.

9 Claims, 4 Drawing Sheets

DOOR HANDLE SYSTEM

BACKGROUND OF THE INVENTION AND RELATED ART STATEMENT

The present invention relates to a door handle system of an automobile, in particular a door handle system having a damper for controlling a speed of a door opening lever returning to an initial position.

An automotive door is provided with a door handle system to operate the door. The door handle system includes a door opening lever interlocked with a latch mechanism for holding the door shut and resiliently biased by a torsion coil spring or the like toward a returning direction. When the door opening lever is pulled against the resilient bias force, the latch mechanism connected to the door opening lever is released to open the door. When the hand is removed from the door opening lever, the door opening lever automatically returns to an initial position with the resilient bias force.

A conventional door handle system occasionally makes an impulsive sound when the door opening lever briskly returns to the initial position with the resilient bias. Accordingly, in order to control a speed at which the door opening lever returns to the initial position, it has been proposed to provide a one-way damper comprising an actuator rotating along the angular movement of the door opening lever; a damping member for receiving a force of viscous oil; and a clutch member disposed between the actuator and the damping member for releasing the operative connection between the actuator and the damping member when the actuator is rotated in one direction against the resilience of an elastic part, and for conveying the rotational force of the actuator to the damping member when the actuator is rotated to the other direction by the resilience of the elastic part (see Patent Reference 1).

Patent Reference 1: Japanese Patent Publication (Kokai) No. 01-250571.

The one-way damper disclosed in Patent Reference 1, however, tends to have a complex structure, as it requires, among other elements, gear and clutch mechanisms. For this reason, any attempt to construct the door handle system so that the door opening lever does not make an impulsive sound when it returns to the initial position inevitably increases manufacturing cost.

In view of the problems described above, an object of the present invention is to provide a door handle system with a damper that can be manufactured at a relatively low cost.

Further objects and advantages of the invention will be apparent from the following description of the invention.

SUMMARY OF THE INVENTION

In order to attain the objects described above, according to a first aspect of the present invention, a door handle system includes a door opening lever (5) pivoted on a member or support member (outer frame 3*a*) substantially integrated with a door panel (inner panel 2) and interlocked with a latch mechanism for holding the door shut. A linearly slidable piston-type damper (11), to which rotational movement of the door opening lever is transmitted through an angle change device, is disposed between the member substantially integrated with the door panel and the door opening lever.

According to a second aspect of the present invention, the angle change device includes a cam (5*d*) rotating together with the door opening lever. The damper includes a piston rod (15) always urged such that the piston rod abuts against an outer circumference of the cam.

According to a third aspect of the present invention, the damper is provided with a channel sectional area changing device for reducing a channel sectional area for oil enclosed in a cylinder as a piston speed increases.

According to a fourth aspect of the present invention, the damper is provided with a one-way valve for increasing a damping force when the damper is contracted relative to when the damper extends.

In the first aspect of the present invention, the damper does not need to directly connect the door opening lever. Accordingly, it is possible to construct the system so as not to apply a resistance of the damper to the door opening lever during the opening operation without a gear or clutch mechanism. Accordingly, it is possible to simplify the construction of the door handle system having the damper and effectively reduce manufacturing cost. In the second aspect, it is possible to arbitrary and widely set a relationship between a rotational angle of the door opening lever and a damping force applied to the piston rod through a setting of a cam profile. In the third aspect, it is possible to apply an optimal damping force according to an angular speed of the door opening lever from the closed position where the spring resilience becomes a maximum value to the initial position where the spring resilience becomes a minimum value. In the fourth aspect, it is possible to reduce the resistance applied to the piston when the damper extends. Accordingly, it is possible to smoothly follow the movement of the door opening lever during the opening operation while the damper is set to obtain a sufficient damping force when contracted.

DETAILED DESCRIPTION OF PREFERRED EMBODIMENTS

Hereunder, embodiments of the present invention will be explained in detail with reference to the attached drawings.

Figure 1:
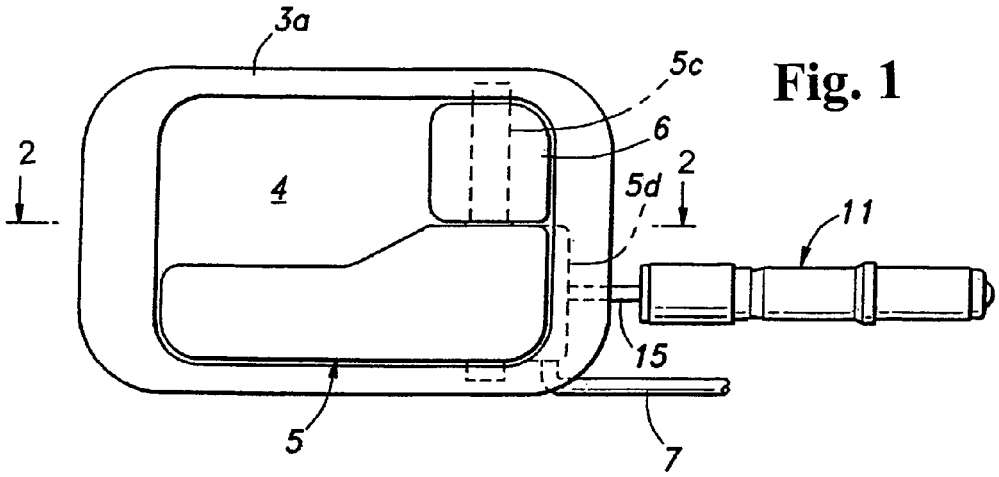
FIG. 1 is a front view of an inside door handle system of an automotive according to a first embodiment of the present invention.
Figure 2:
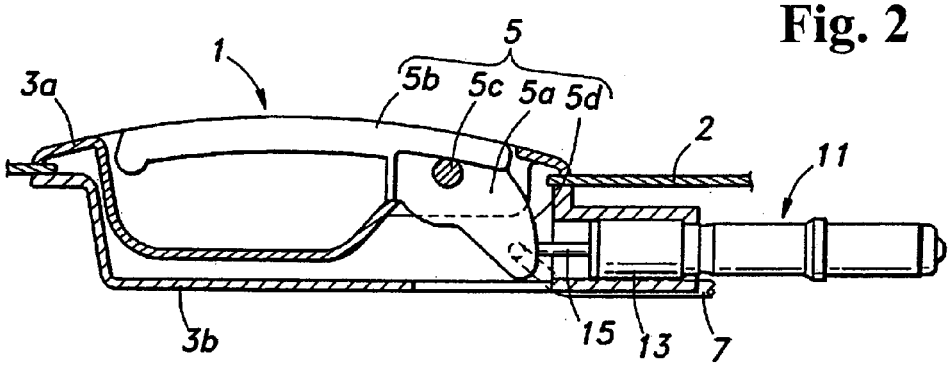
FIG. 2 is a top partial sectional view of the inside door handle system in a normal state taken along line 2—2 in FIG. 1.
Figure 3:
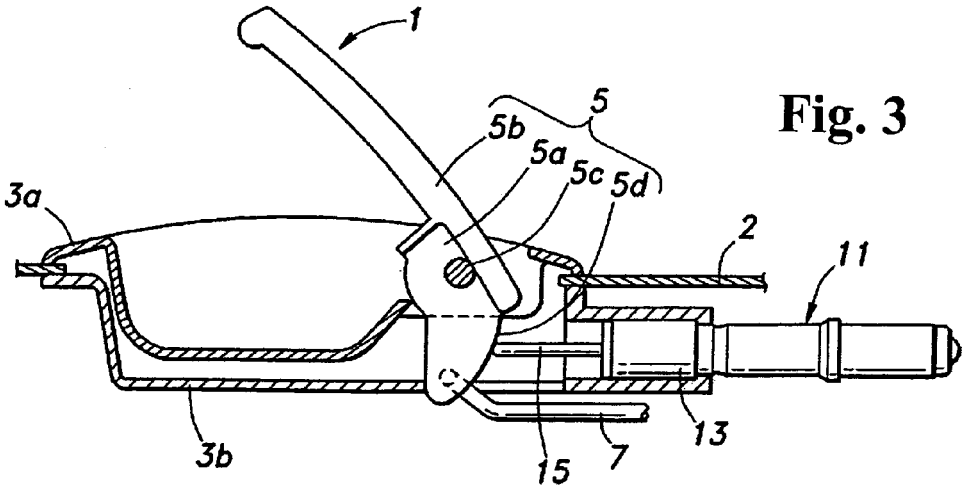
FIG. 3 is a top view of the inside door handle system similar to FIG. 2 when a door is opened.

FIGS. 1 and 2 show an automotive inside door handle system to which the present invention is applied. An inside door handle system 1 has an outer frame 3*a* and an inner frame 3*b* to be integrated with an inner panel 2 of a door; and a door opening lever 5 and a locking lever 6 installed to be received within a recess 4 formed in a cabin side surface of the outer frame 3*a*.

The door opening lever 5 integrally comprises a body 5*a*, which is the center of the angular movement, a lever 5*b*, which extends from the body 5*a* in the direction perpendicular to the rotational axis, a shaft 5*c*, which coaxially projects vertically from the body 5*a*, and a cam 5*d*, which is disposed on the opposite side of the lever 5*b* across the shaft 5*c*. The locking lever 6 is pivoted to an upper side of the shaft 5*c*, and upper and lower ends of the shaft 5*c* are respectively pivoted to upper and lower walls of the outer frame 3*a*.

The cam 5*d* is connected to one end of a connecting rod 7 for interlocking a latch mechanism (not shown) and the door opening lever 5. The door opening lever 5 rotates in the direction to stand up relative to the outer frame 3*a*, and releases the latch mechanism to allow the door to open. The door opening lever 5 is resiliently biased by a torsion coil spring (not shown) toward the recess 4 of the outer frame 3*a* so as to maintain an initial position (the state shown in FIG. 2) along the cabin side surface of the outer frame 3*a* in a normal state. Any known latch mechanism construction available in practical use can be applied, and explanation thereof is omitted.

A tip of the piston rod 15 of the damper 11 (described later) abuts against an outer surface of the cam 5*d*. A cam profile is set so that a contact point of the tip of the piston rod 15 on the outer surface approaches the center of the rotation as the rotational angle of the door opening lever 5 increases during the opening operation.

The damper 11 comprises a cylinder 13 fastened to the inner frame 3*b* in a state wherein an axis thereof extends roughly in parallel with the connecting rod 7. Accordingly, the housing space for the connecting rod 7 normally provided in the inside door handle system 1 can be utilized for disposing the damper 11. Thus, no special consideration is necessary for the space for the damper 11.

Figure 4:
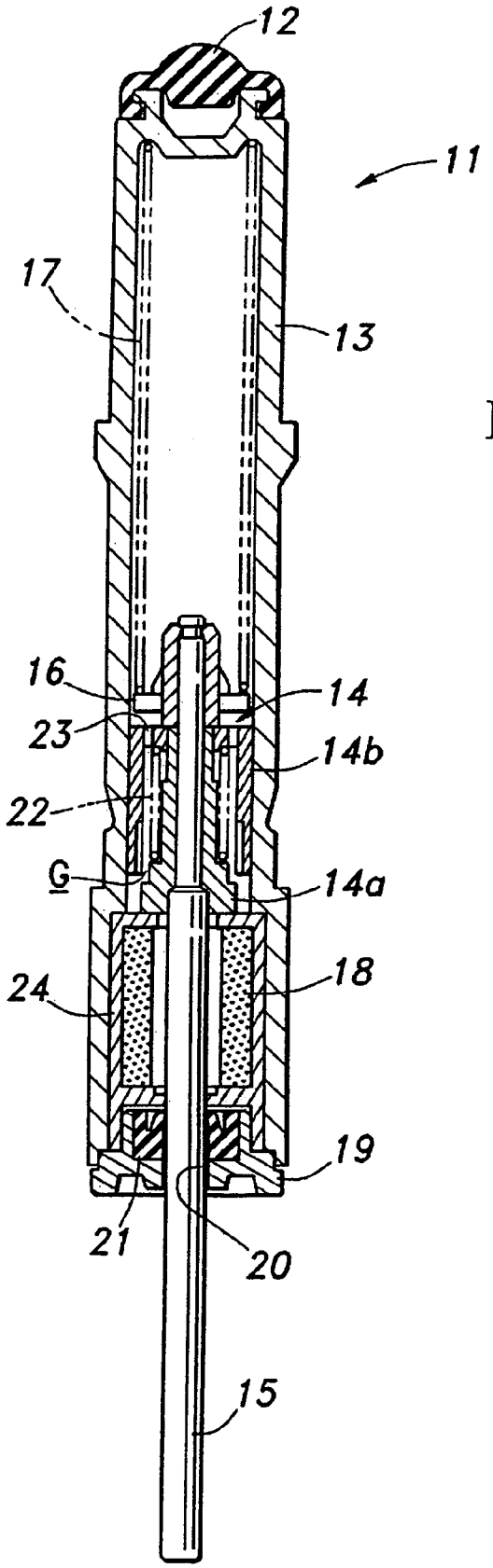
FIG. 4 is a longitudinal sectional view of a damper when extends (low-speed operation)
Figure 5:
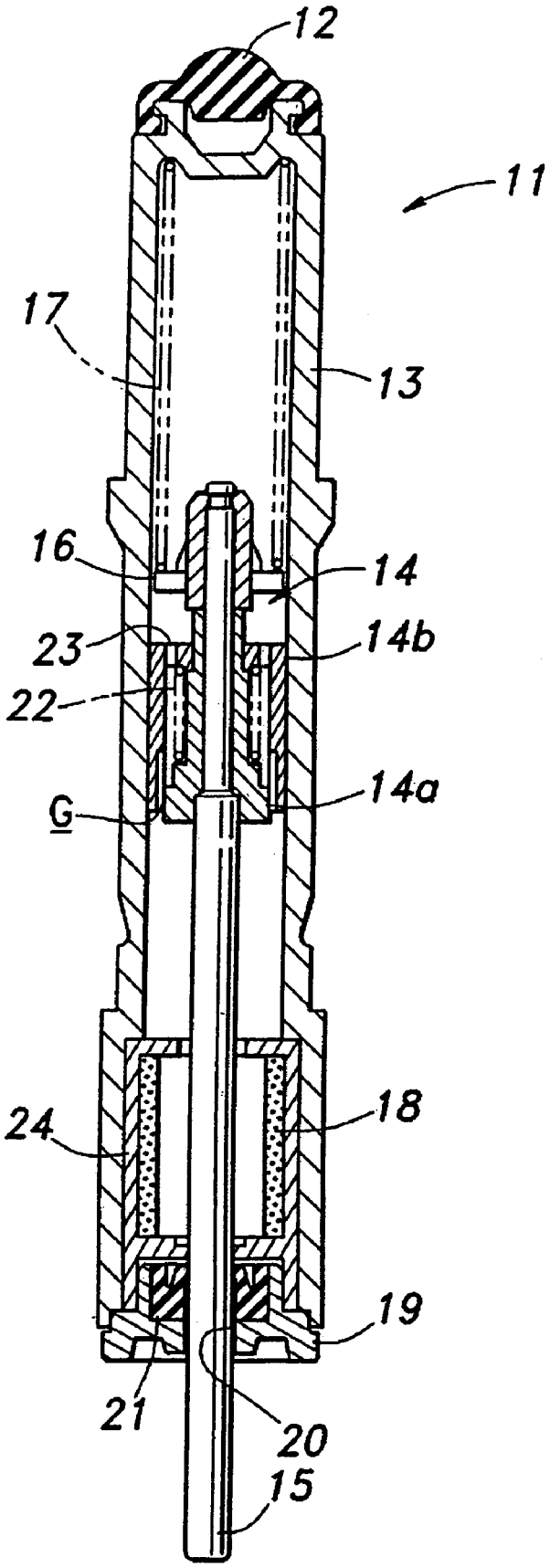
FIG. 5 is a longitudinal sectional view of the damper when contracted (high-speed operation)

The damper 11 will be further explained with reference to FIGS. 4 and 5. The damper 11 comprises the cylinder 13, which has a closed bottom with a rubber cushion 12 attached to the outer end surface thereof; a piston 14, which rubs against the inside of the cylinder 13; a piston rod 15, which is connected to the piston 14; a first compression coil spring 17, which is disposed between a spring retainer 16 disposed at the inner end of the piston rod 15 and the bottom wall inner surface of the cylinder 13 in a compressed state; an accumulator 18, which is disposed on the top side of the cylinder; and a cap 19, which seals the opening at the top of the cylinder. The piston rod 15, inserted through the center hole 20 of the cap 19 via an oil seal 21, projects outside of the cylinder 13. Silicon oil having an appropriate viscosity is enclosed within the cylinder 13.

The piston 14 comprises an inner member 14*a*, which is substantially integrated with the inner end section of the piston rod 15; and an outer member 14*b*, which loosely fits with the inner member 14*a* leaving a predetermined amount of space G from the outer surface thereof and rubs against the inner surface of the cylinder 13. A second compression coil spring 22 is disposed between the inner member 14*a* and the outer member 14*b* to resiliently bias the two to separate in the axial direction. The outer diameter of the inner member 14*a* is varied in steps, and the outer end side becomes larger, so that the space G between the inner member 14*a* and outer member 14*b* narrows as the inner member 14*a* plunges into the outer member 14*b*. These components comprise a channel sectional area changing device, which decreases a sectional area of a channel for oil enclosed within the cylinder in accordance with the increase in the piston speed, and a one-way valve for making the damping force greater when the damper is contracted than when extended. The outer member 14*b* has a cylindrical shape with a bottom, and the bottom wall has a fixed orifice 23 with an appropriate diameter to allow silicon oil to pass through.

The accumulator 18 is appropriately resilient and formed in a cylindrical shape with a foam synthetic resin so as to contract when a predetermined level of pressure is applied, and is held over the inner surface of the cylinder on the top side via a retainer 24.

In the inside door handle system 1, including the damper 11 constructed as above, the door opening lever 5 is normally in the initial position along the cabin side inner surface of the outer frame 3*a* due to the resilience of the torsion coil spring (FIG. 2). Although the resilience of the first compression coil spring 17 is applied to the piston rod 15 in the extending direction, the piston rod 15 is forcibly contracted because the force for maintaining the initial position applied to the door opening lever 5 is greater. Moreover, the outer member 14*b* of the piston 14 is pushed against the spring retainer 16 disposed at the inner end side of the piston rod 15 by the resilience of the second compression coil spring 22, and the space G between the outer member 14*b* and the inner member 14*a* is maintained wide.

When the door opening lever 5 is operated to open the door from this state, the outer surface of the cam 5*d* is displaced in the direction to reduce the pushing force applied to the piston rod 15. Thus, the piston rod 15 moves in the extending direction using the resilience of the first compression coil spring 17. In this state, the outer member 14*b* and the inner member 14*a* are separated by the resilience of the second compression coil spring 22, and the outer member 14*b* has not moved because of the movement of silicon oil from the top side to the bottom side. Accordingly, the space G between the outer member 14*b* and the inner member 14*a* is maintained wide. Thus, the flow resistance of silicon oil moving from the top side to the bottom side through the fixed orifice 23 and the space G of the outer member 14*b* of the piston 14 is maintained within a relatively low range, roughly determined by the open area of the fixed orifice 23. Accordingly, the piston rod 15 extends out smoothly following the opening operation of the door opening lever 5 while maintaining the state wherein the tip of the piston rod 15 abuts against the outer surface of the cam 5*d*.

When a finger is removed from the door opening lever 5 after the latch mechanism is released and the door is opened, the door opening lever 5 rotates to automatically return to the initial position. Then, the piston rod 15 in the extended state is pushed by the external surface of the cam 5*d* rotating integrally with the door opening lever 5 into the cylinder 13 against the resilience of the first compression coil spring 17. At this time, silicon oil on the bottom side moves to the top side via the fixed orifice 23 of the outer member 14*b* of the piston 14 and the space G between the outer member 14*b* and the inner member 14*a*. The flow resistance of silicon oil during this process dampens the energy applied to the piston rod 15; that is, damping the piston rod 15.

The flow resistance of silicon oil progressively increases relative to the piston speed. Accordingly, by setting the second compression coil spring 22 so as to be contracted by the speed at which the door opening lever 5 returns from the maximally tilted position to the initial position, namely, the resistance of silicon oil applied to the outer member 14*b* of the piston 14 when the door opening lever 5 generates the maximum angular speed to maximize the resilient bias applied to the door opening lever 5, the second compression coil spring 22 contracts with the returning speed of the door opening lever 5 to allow the inner member 14*a* to enter the outer member 14*b*, as shown in FIG. 5. Since the space G between the inner member 14*a* and the outer member 14*b* is narrowed, the damping force due to the flow resistance of silicon oil increases further.

As the door opening lever 5 returns to the initial position, the resilient bias applied to the door opening lever 5 decreases. The flexure of the second compression coil spring 22 varies in proportion to the changes in the angular speed of the door opening lever 5 to automatically adjust the damping force optimally to thereby control the generation of impulsive sound without reducing the smoothness in the motion of the door opening lever 5 in returning to the initial position.

When the piston rod 15 enters the cylinder 13, the content volume of the cylinder 13 decreases correspondingly, thereby increasing the pressure of silicon oil. This, however, is absorbed by the compressive deformation of the accumulator 18 formed of a foam synthetic resin.

In the embodiment described above, the tip of the piston rod 15 directly abuts against the cam 5*d*. However, a cam follower made of a highly lubricated synthetic resin may be interposed between the piston rod 15 and the cam 5*d*, for example, to reduce the generation of rubbing noise and wear of the cam 5*d* caused by the contact between metal members.

With the cam described above, it is possible to arbitrary set a relationship between a rotational angle of the door opening lever 5 and a moving distance of the piston rod 15 through a setting of a curvature of an abutting end surface of the piston rod 15 at the cam 5*d*. For example, within a specific range, it is possible to increase a moving speed of the piston rod 15 to apply a strong damping force, or to stop the piston rod 15 not to apply a damping force even when the door opening lever 5 is rotated.

Moreover, the tilting motion of the door opening lever 5 is conveyed to the piston rod 15 by the cam 5*d* integrated with the connecting section of the connecting rod 7. An arm appropriately angled and shaped in accordance with the position of the damper 11 may be disposed separately from the connection section of the connecting rod 7.

Likewise, the channel sectional area changing device and the one-way valve are not limited to the constructions described above. They may be embodied in various modifications, such as one having plural orifices, some of which are provided with a reed valve.

Figure 6:
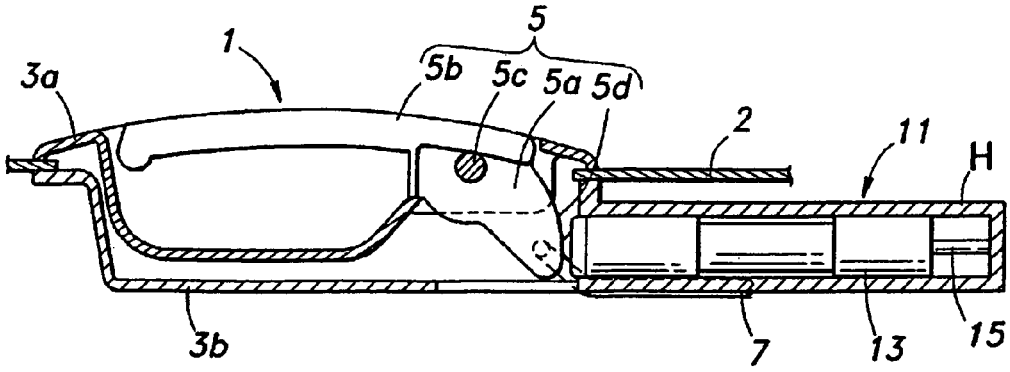
FIG. 6 is a top view of an inside door handle system similar to FIG. 2 according to a second embodiment of the present invention.
Figure 7:
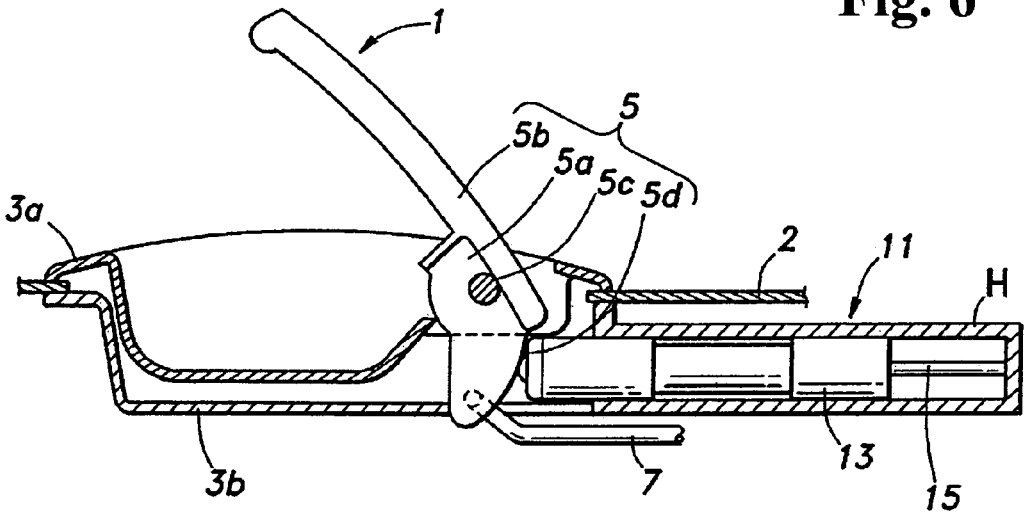
FIG. 7 is a top view of the inside door handle system similar to FIG. 3 according to the second embodiment.

Furthermore, in addition to the above construction for conveying the tilting motion of the door opening lever 5 to the piston rod 15, the system may be constructed as shown in FIGS. 6 and 7, wherein a holder H that slidably holds the cylinder 13 is disposed integrally with the inner frame 3*b*, and the end section of the cylinder 13 at the bottom, namely, the rubber cushion 12, abuts against the cam 5*d* while placing the tip of the piston rod 15 flush against the bottom wall of the holder H.

The present invention has been described in detail above by referring to examples applicable to an inside door handle system, but the present invention, needless to say, is applicable to an outside door handle.

The disclosure of Japanese Patent Application No. 2004-143133, filed on May 13, 2004, is incorporated in the application.

While the invention has been explained with reference to the specific embodiments of the invention, the explanation is illustrative and the invention is limited only by the appended claims.

What is claimed is:

1. A door handle system, comprising:

a door opening lever rotationally supported on a support member, and having a cam rotating together with the door opening lever as an angle change device for changing an angle when the door opening lever is actuated, a connecting rod attached to the door opening lever adapted to actuate a latch mechanism for a door, and a damper having a linear piston sliding mechanism and including a cylinder and a piston rod formed separately from the connecting rod and slidably disposed in the cylinder, one of said cylinder and said piston rod being attached to the support member and the other of said cylinder and said piston rod being always urged to contact the cam as the angle change device so that a returning force of the door opening lever after being opened is reduced by the damper.

2. A door handle system according to claim 1, wherein said angle change device changes a rotational movement of the door opening lever to a linear movement.

3. A door handle system according to claim 1, wherein said damper includes a channel area changing device attached to the piston rod for reducing a sectional area of a channel of fluid filled in the cylinder according to a moving speed of the piston.

4. A door handle system, comprising:

a door opening lever rotationally supported on a support member, and having an angle change device for changing an angle when the door opening lever is actuated, and a damper having a linear piston sliding mechanism, said damper being attached to the support member and arranged to contact the angle change device so that a returning force of the door opening lever after being opened is reduced by the damper, wherein said damper includes a cylinder, a piston rod slidably disposed in the cylinder, and a channel area changing device attached to the piston rod for reducing a sectional area of a channel of fluid filled in the cylinder according to a moving speed of the piston, and wherein said channel area changing device includes an inner member fixed onto the piston rod, a cylindrical outer member situated outside the inner member and having an orifice at one side thereof, and a spring situated between the inner and outer members to urge the outer member to move away from the inner member.

5. A door handle system according to claim 4, wherein said inner member has at least one step portion in a longitudinal direction of the piston rod to thereby change the sectional area according to the movement of the outer member.

6. A door handle system according to claim 1, wherein said damper includes a one-way valve for increasing the damping force when the damper contracts.

7. A door handle system according to claim 1, wherein said cam is situated between the door handle and a portion where the connecting rod is attached.

8. A door handle system according to claim 7, wherein said connecting rod is arranged substantially parallel to the piston rod.

9. A door handle system according to claim 8, wherein said cylinder is fixed to the support member, and the piston rod contacts the cam.

* * * * *